US006457490B2

(12) United States Patent
Dewispelaere et al.

(10) Patent No.: US 6,457,490 B2
(45) Date of Patent: Oct. 1, 2002

(54) LOOP PILE FABRIC AND METHOD FOR WEAVING IT

(75) Inventors: Andre Dewispelaere, Kortrijk/Marke; Gilbert Moulin, Rekkem, both of (BE)

(73) Assignee: N.V. Michel Van de Wiele, Kortrijk/Marke (BE)

( * ) Notice: Subject to any disclaimer, the term of this patent is extended or adjusted under 35 U.S.C. 154(b) by 0 days.

(21) Appl. No.: 09/783,102

(22) Filed: Feb. 15, 2001

(30) Foreign Application Priority Data

Feb. 25, 2000 (BE) ..... 2000/0152

(51) Int. Cl.[7] ..... D03D 27/00

(52) U.S. Cl. ..... 139/391; 139/399; 139/401; 139/402; 139/403

(58) Field of Search ..... 139/391, 399, 139/401, 402, 403

(56) References Cited

U.S. PATENT DOCUMENTS 2,599,293 A 6/1952 Symonds
2,860,669 A 11/1958 Moberg
3,625,260 A * 12/1971 Troy ..... 139/46

FOREIGN PATENT DOCUMENTS

BE 1 010 423 7/1998

* cited by examiner

*Primary Examiner*—Andy Falik
*Assistant Examiner*—Robert H. Muromoto, Jr.
(74) *Attorney, Agent, or Firm*—James Creighton Wray; Meera P. Narasimhan

(57) ABSTRACT

A method for manufacturing a loop pile fabric with a varied appearance includes a woven backing fabric. Loop weft yarns (12A), (12B) are provided outside the backing fabric, and loop warp yarns (1), (2), (3) are so provided that they are alternately inwoven in the backing fabric and form a pile loop (13), (14) over at least one loop weft yarn (12A), (12B), and the loop weft yarns (12A), (12B) are subsequently removed. By providing first (12A) and second loop weft yarns (12B) with a different thickness, pile loops (13), (14) of different height are formed. To obtain a fabric in which both pile loops (13) and cut pile (15) occur subsequently a top part can be removed from a number of pile loops (13). In areas (19) where no pile loops are formed effect backing weft yarns (11B) with laterally protruding filaments can be inwoven in the backing fabric. A loop pile fabric can be manufactured according to this method.

14 Claims, 1 Drawing Sheet

LOOP PILE FABRIC AND METHOD FOR WEAVING IT

BACKGROUND OF THE INVENTION

This invention relates to a method for manufacturing a loop pile fabric, whereby a backing fabric is woven out of backing warp yarns and backing weft yarns, and whereby loop warp yarns and loop weft yarns are so provided that loop warp yarns are alternately inwoven in the backing fabric and form a pile loop over at least one loop weft yarn running outside the backing fabric, and whereby the loop weft yarns are subsequently removed.

This invention also relates to a loop pile fabric comprising a backing fabric woven out of warp yarns and weft yarns, and at least one area in which loop warp yarns are alternately inwoven in the backing fabric and form a pile loop protruding from the backing fabric. In particular this invention relates to a loop pile fabric that is manufactured according to a method with the above mentioned characteristics.

Weaving such loop pile fabrics according to a weaving method with the above mentioned characteristics is known. According to a widely applied weaving method the loop weft yarns are inserted above a series of lancets that extend stationary in warp direction above the backing fabric. These lancets hold the loop weft yarns at a certain distance above the backing fabric with the result that the loop warp yarns passed over these loop weft yarns form pile loops which protrude from the backing fabric over a certain height. This pile loop height, which is determined by the distance between the top edges of the lancets and the backing fabric, is the same for all pile loops of the fabric.

In the Belgian patent publication no. 1010423A3 such a method is described according to which apart from the ordinary upright pile loops, left-directed and right-directed pile loops can also be formed by inweaving at various levels in the backing fabric the backing weft yarns inwoven in the backing fabric on both sides of the pile loops, with the purpose of bringing some more variation into the appearance of loop pile fabrics.

Through this method the possibility is available of weaving a loop pile fabric in which, according to a well-determined pattern, areas with left-directed pile loops, areas with right-directed pile loops and areas with upright pile loops occur. Such a loop pile fabric indeed has a more varied appearance than pile loop fabrics with only upright pile loops.

Providing areas without loops is furthermore also known, in order to bring more variation into these types of fabrics. Such areas are usually indicated by the technical term "carving areas".

The possibilities of introducing variation into the appearance of loop pile fabrics, according to these known methods, anyhow remain rather limited. A purpose of this invention consists in providing a method with the characteristics mentioned in the first paragraph of this specification, which through simple measures succeeds in offering additional possibilities of bringing variation into the appearance of pile loop fabrics.

SUMMARY OF THE INVENTION

According to this invention the above mentioned objective is achieved by providing a method whereby first and second loop weft yarns with a different thickness are provided, so that pile loops of different height are formed.

For the sake of clarity it should be pointed out that, where in this specification and in the claims attached hereto "the height of a pile loop" is mentioned, is meant: the height over which that pile loop protrudes above the backing fabric.

A loop warp yarn that is passed around over a thick loop weft yarn forms a loop with a greater height than a loop warp yarn that is passed around over a thinner weft yarn. In this very simple to implement and inexpensive, but nevertheless particularly efficient manner pile loops with a different height are obtained in a loop pile fabric.

This method therefore enables first and second areas to be created in a loop pile fabric of which the respective pile loops have a different height. Because of this new possibilities are available during the weaving of loop pile fabrics for implementing a striking variation in the appearance of this fabric.

This possibility of implementing areas with pile loops of different height can of course also be applied in combination with one or several of the already existing possibilities, namely the creation of one or more areas without pile loops, with directed pile loops, or with upright pile loops.

According to a preferred method according to this invention subsequently a top part is removed from a number of pile loops, so that a fabric is formed in which both pile loops and cut pile occur.

In this specification and in the claims the term "cut pile" is used in the sense of a series of pile yarns protruding from the backing fabric which for example are anchored by inweaving in that backing fabric and of which each protruding part is the single end part of a pile yarn. This in contrast to a pile loop of which the part protruding from the backing fabric is a loop-shaped passed-around part of a pile yarn.

By removing the top part from a number of loops, for example by shearing these away, both areas with pile loops and areas with cut pile can be achieved in a same fabric. The areas with cut pile produce a velvet effect in the fabric. The yarn parts protruding from the backing fabric can be rather long so that a so-called high-pile velvet effect is obtained. The visible structure of an area with cut pile differs in very striking manner from the visible structure of an area with pile loops. By means of these very clear structure variations it is possible to manufacture loop pile fabrics which have a pronounced varied appearance along the pile side.

Preferably high and low pile loops are formed in the fabric, and the top parts of a number of high pile loops are removed. Because of the fact that the high pile loops protrude above the low pile loops it is very easy to remove a protruding top part thereof. This can be effected for example mechanically whereby the top part is automatically sheared away at a predetermined height.

The top parts of a number of high pile loops are moreover preferably removed so far that the upright pile yarns of the thus formed cut pile have almost the same height as the low pile loops of the fabric. In this manner a preferred fabric is obtained in which the cut pile yarns protrude over almost the same height above the backing fabric as the pile loops. From an aesthetic point of view such a fabric has the advantage that it has a same pile height both in the areas with pile loops and in the areas with cut pile.

According to a very preferred method high pile loops with a first height and low pile loops with a lesser second height are formed in the fabric, and afterward a top part is removed from all high pile loops so that the thus formed pile yarns have almost the same height as the low pile loops of the fabric.

With the method according to this invention preferably at least one area with pile loops and at least one area with cut pile is also formed according to a predetermined pattern or design.

According to this method in the fabric preferably at least one area with obliquely directed pile loops and/or at least one area without pile yarns is also formed.

According to a particularly preferred method according to this invention in the fabric, in an area where no pile loops are formed, effect backing weft yarns with laterally protruding filaments, in particular hairy backing weft yarns, are inwoven in the backing fabric.

Because of this the effect of low pile velvet is obtained in the loop pile fabric. This provides yet another visible structure in the fabric, with the result that the fabric obtains a still more varied appearance.

Through the above described cut pile a high-pile velvet effect is created. The effect backing weft yarns can produce a low-pile velvet effect in areas without pile loops. Furthermore the possibilities also exist of forming ordinary upright or left- or right-directed pile loops, and of forming areas without pile loops in which no low-pile velvet effect is created. All the possibilities of bringing variation into a loop pile fabric can be combined entirely at will. It is the merit of this invention that the number of variation possibilities is greatly increased in comparison to the known methods. For the aforesaid effect backing weft yarns preferably chenille yarns or flock yarns are used.

The method according to this invention is preferably so implemented that the loop weft yarns are separated during the weaving of the backing fabric by stationary lancets extending in warp direction.

An additional purpose of this invention is also to provide a pile loop fabric with the properties mentioned in the first paragraph of this specification, of which the pile side has a varied appearance that is manifested through another property than by the pile loop direction or the absence of pile loops.

As sufficiently clearly appears from that which precedes this purpose is achieved by providing a loop pile fabric with a first and a second area of which the respective pile loops have a different height, or by providing a loop pile fabric which comprises a first and a second area, respectively with pile loops and with cut pile.

This loop pile fabric can be manufactured in a particularly advantageous manner by applying the method according to this invention (see above), but such loop pile fabrics that are manufactured according to other weaving methods comply with the specified purpose and fall within the scope of this invention.

The loop pile fabric according to this invention is preferably a fabric in which at least one area with pile loops and at least one area with cut pile yarns is formed, and in which the cut pile yarns protrude as pile loops over almost the same height above the backing fabric.

A very special embodiment of this fabric according to the invention is characterized due to the fact that it comprises at least one area in which no pile loops are formed, and in which effect backing weft yarns with laterally protruding filaments, in particular hairy backing weft yarns, such as among others chenille yarns and flock yarns, are inwoven in the backing fabric.

The invention is now further explained on the basis of the following detailed specification of a loop pile fabric according to this invention and of a method for manufacturing such a fabric. The fabric and the method that are described hereafter are however no more than an example of how the invention could be implemented, and has the sole purpose of clarifying the invention and specifying further distinctive features or advantages thereof.

It is clear that still numerous other fabrics and methods differing here from can be implemented within the scope of this invention, and that the following specification can therefore in no way be interpreted as a restriction on the field of application of the invention or on the patent rights claimed in the claims.

In this specification reference is made by means of reference numbers to the figures attached hereto, of which

DETAILED DESCRIPTION

The cross-sections represented in the figures show the binding warp yarns (4), (5), the tension warp yarns (6), (7) and the loop warp yarns (1), (2), (3) of one warp yarn system, as well as the backing weft yarns (9), (10), (11A), (11B) and the loop weft yarns (12A), (12B) that work together with these warp yarns in order to form a loop pile fabric according to this invention.

Figure 1:
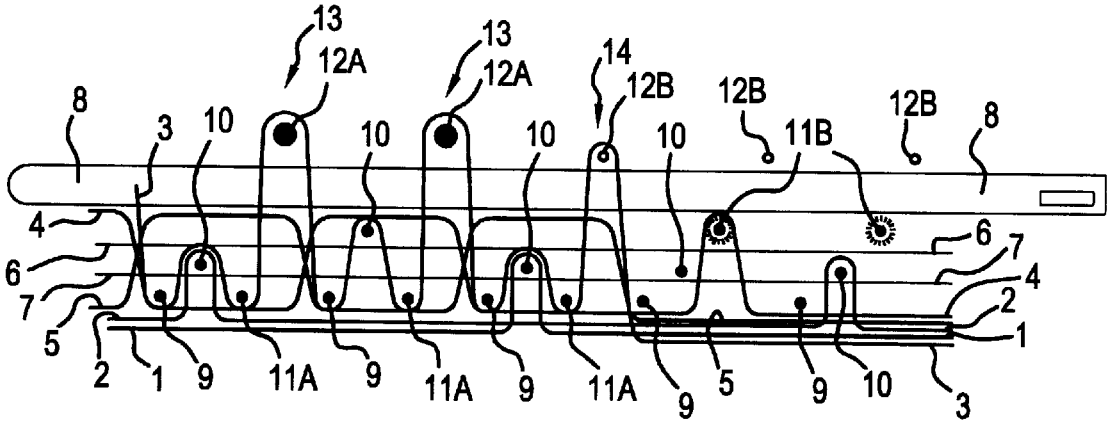
FIG. 1 shows a schematic cross-section in warp direction of a part of a loop pile fabric, during the weaving thereof according to a weaving method according to this invention.
Figure 2:
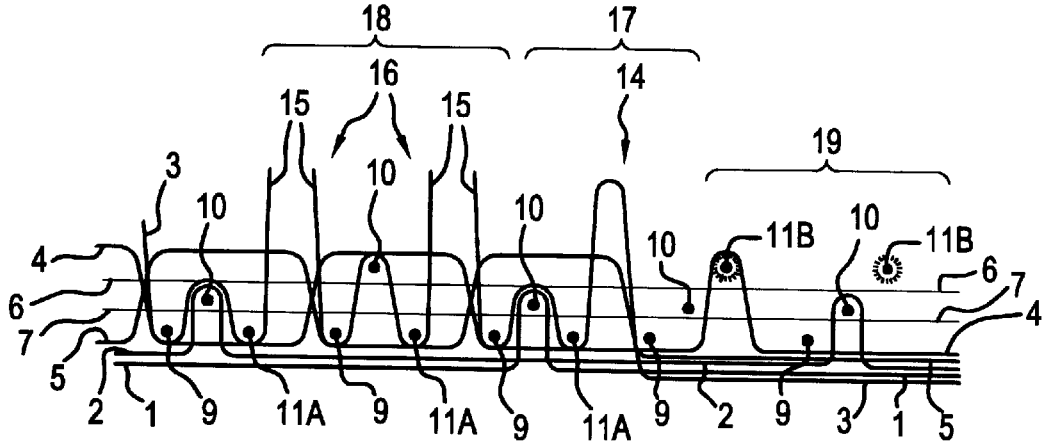
FIG. 2 shows a schematic cross-section according to the warp direction of the same fabric part as FIG. 1, after the fabric is finished.

On a known weaving machine a series of such warp yarn systems are provided next to each other. In the course of successive operating cycles of the weaving machine in each case a shed is formed between these warp yarns, and in this shed a weft yarn (9), (10), (11A), (11B), (12A), (12B) is inserted. In the successive sheds the various warp yarns are so positioned in relation to the weft insertion level that these warp yarns in each warp yarn system take up the positions in relation to the successive weft yarns represented in FIG. 1.

The backing weft yarns (9), (10), (11A of 11B) are moreover inwoven by the binding warp yarns (4), (5) so that a backing fabric is formed. The two tension warp yarns (6), (7) are provided one above the other in the backing fabric. The backing weft yarns are inwoven in the backing fabric at three different levels: below the two tension warp yarns (6), (7), between the two tension warp yarns (6), (7) and above the two tension warp yarns (6), (7).

In successive series of four successive operating cycles in each case in the course of the fourth operating cycle a loop weft yarn (12A), (12B) is inserted above a lancet (8) extending above the backing fabric.

In order to form pile loops (13), (14) a loop warp yarn (1) (2), (3) is alternately inwoven in the backing fabric and passed around over a loop weft yarn (12A), (12B). The three loop warp yarns (1), (2), (3) have a different color. Depending on the desired color of the pile yarns, e.g. according to a predetermined pattern or design, a different loop warp yarn (1), (2), (3) is used in order to form the pile loops (13), (14).

The inwoven non-loop-forming loop warp yarns are brought along the back of the fabric and are now and then brought above a backing weft yarn (10) of the middle level or a backing weft yarn (11A) of the top level. The effect backing weft yarn (11B) may however not be covered by inwoven loop warp yarns (1), (2), (3).

Through the use of thick loop weft yarns (12A) and thin weft yarns (12B) respectively high pile loops (13) and low pile loops (14) are formed.

In order to create an area (19) without pile loops in the fabric all loop warp yarns can be brought along the back of the fabric. In such an area (19) a low-pile velvet effect can be achieved by inweaving weft yarns (11B) with laterally protruding filaments. These particular backing weft yarns (11B) are in each case inserted as third weft yarn of the successive series of four weft yarns (9), (10), (11A or 11B), (12A or 12B). Chenille yarns or flock yarns are particularly well suited for this purpose.

These effect weft yarns (11B) are inwoven in the backing fabric at the top level, above the two tension warp yarns (6), (7). The loop weft yarns (12A), (12B) are finally removed. A fabric is obtained with an area with high pile loops, an area with low pile loops, and an area without pile loops where by means of the effect backing weft yarns (11B) a low-pile velvet effect is created (see figure This fabric can as such be used or marketed as a loop pile fabric with the particular advantage that it has a varied appearance through the pile loops of different height.

In a subsequent treatment the tops of the highest pile loops (13) can be sheared away, so that areas (18) with cut pile (16) are formed. The high loops (13) are sheared away to the height of the remaining low loops (14).

A loop pile fabric is thus obtained in which an area (17) with pile loops. (14), an area (18) with cut pile and an area (19) without pile loops but with low-pile velvet effect occurs. The cut pile has a rather great pile height and produces a high-pile velvet effect.

A loop pile fabric with a pronounced variation of the structure that is visible along the pile side is thus obtained according to a particularly simple method.

What is claimed is:

1. A method for manufacturing a loop pile fabric comprising weaving a backing fabric out of backing warp yarns and backing weft yarns, inweaving loop warp yarns and loop weft yarns in the backing fabric such that the loop warp yarns are alternately inwoven in the backing fabric, forming a pile loop over at least one loop weft yarn running outside the backing fabric, removing the loop weft yarns subsequently, providing first and second loop weft yarns with different thicknesses, and forming pile loops of different heights.

2. The method of claim 1, further comprising removing top portions of a number of pile loops and forming a fabric comprising pile loops and cut pile.

3. The method of claim 2, wherein the forming comprises forming the fabric with high pile loops and low pile loops, and wherein the removing comprises removing the top portions of a number of the high pile loops and forming the cut pile.

4. The method of claim 3, further comprising forming upright pile yarns by the removing of the top portions, and wherein the removing comprises removing sufficient lengths of the top portions of the high pile loops such that the upright pile yarns have heights substantially similar to heights of the low pile loops of the fabric.

5. The method of claim 2, wherein the removing the top portions comprises shearing away the top portions of the pile loops.

6. The method of claim 2, wherein the forming comprises forming the fabric with a predetermined pattern or design comprising at least one area with the pile loops and at least one area with the cut pile.

7. The method of claim 2, wherein the forming comprises forming the fabric with a predetermined pattern or design comprising at least one area with obliquely directed pile loops.

8. The method of claim 2, wherein the forming comprises forming the fabric with a predetermined pattern or design comprising at least one area without the pile loops.

9. The method of claim 1, further comprising separating the loop weft yarns during weaving of the backing fabric by stationary lancets extending in warp direction.

10. A loop pile fabric made according to the method of claim 1.

11. A loop pile fabric comprising a backing fabric of warp yarns and weft yarns, at least one area in the backing fabric comprising loop warp yarns alternately inwoven in the backing fabric forming a pile loop protruding from the backing fabric, a pile loop area with pile loops on the fabric, a cut pile area with cut pile yarns on the fabric, at least one other area in the fabric having no pile loops, and effect backing weft yarns with laterally protruding filaments being inwoven in the backing fabric.

12. The fabric of claim 11, wherein the cut pile yarns have protrusions extending over a height above the backing fabric substantially similar to a height of the pile loops.

13. A loop pile fabric comprising a backing fabric woven out of warp yarns and weft yarns, at least one area with loop warp yarns alternately inwoven in the backing fabric and forming a pile loop protruding from the backing fabric, a first and a second area of pile loops comprising respective pile loops having different heights, at least one area on the fabric having no pile loops, and effect backing weft yarns with laterally protruding filaments inwoven in the backing fabric.

14. The fabric of claim 13, wherein the weft yarns are hairy backing weft yarns.

* * * * *